United States Patent [19]

Galli, Jr.

[11] 4,177,556

[45] Dec. 11, 1979

[54] WATER DISPENSING RAZOR

[76] Inventor: Ralph Galli, Jr., 191 Bay 32nd St., Brooklyn, N.Y. 11214

[21] Appl. No.: 890,458

[22] Filed: Mar. 27, 1978

[51] Int. Cl.[2] ..... B26B 21/40

[52] U.S. Cl. ..... 30/41

[58] Field of Search ..... 30/41, 123.3

[56] References Cited

U.S. PATENT DOCUMENTS

| | | | |
|---|---|---|---|
| 1,938,481 | 12/1933 | Black | 30/41 |
| 2,131,498 | 9/1938 | Chandler | 30/41 |
| 2,336,806 | 12/1943 | Schenk | 30/41 |
| 2,705,365 | 4/1955 | Van Heest | 30/41 |
| 3,143,984 | 8/1964 | Morasch | 30/123.3 X |
| 3,417,468 | 12/1968 | Miyauchi | 30/41 |

FOREIGN PATENT DOCUMENTS

| | | | |
|---|---|---|---|
| 152005 | 7/1951 | Australia | 30/41 |
| 597918 | 2/1948 | United Kingdom | 30/41 |

*Primary Examiner*—Gary L. Smith

*Attorney, Agent, or Firm*—Robert D. Farkas

[57] ABSTRACT

A safety razor for a single edge type blade includes a longitudinal passageway through the handle with a lateral slotted opening in the shaving head over the blade. The lower end of the handle is connected by flexible tubing to a water faucet which supplies water through the passageway. The water flows out of the slot across the blade to continuously lubricate the facial areas being shaved. An adjustable clamp on the tubing regulates the flow of water.

3 Claims, 3 Drawing Figures

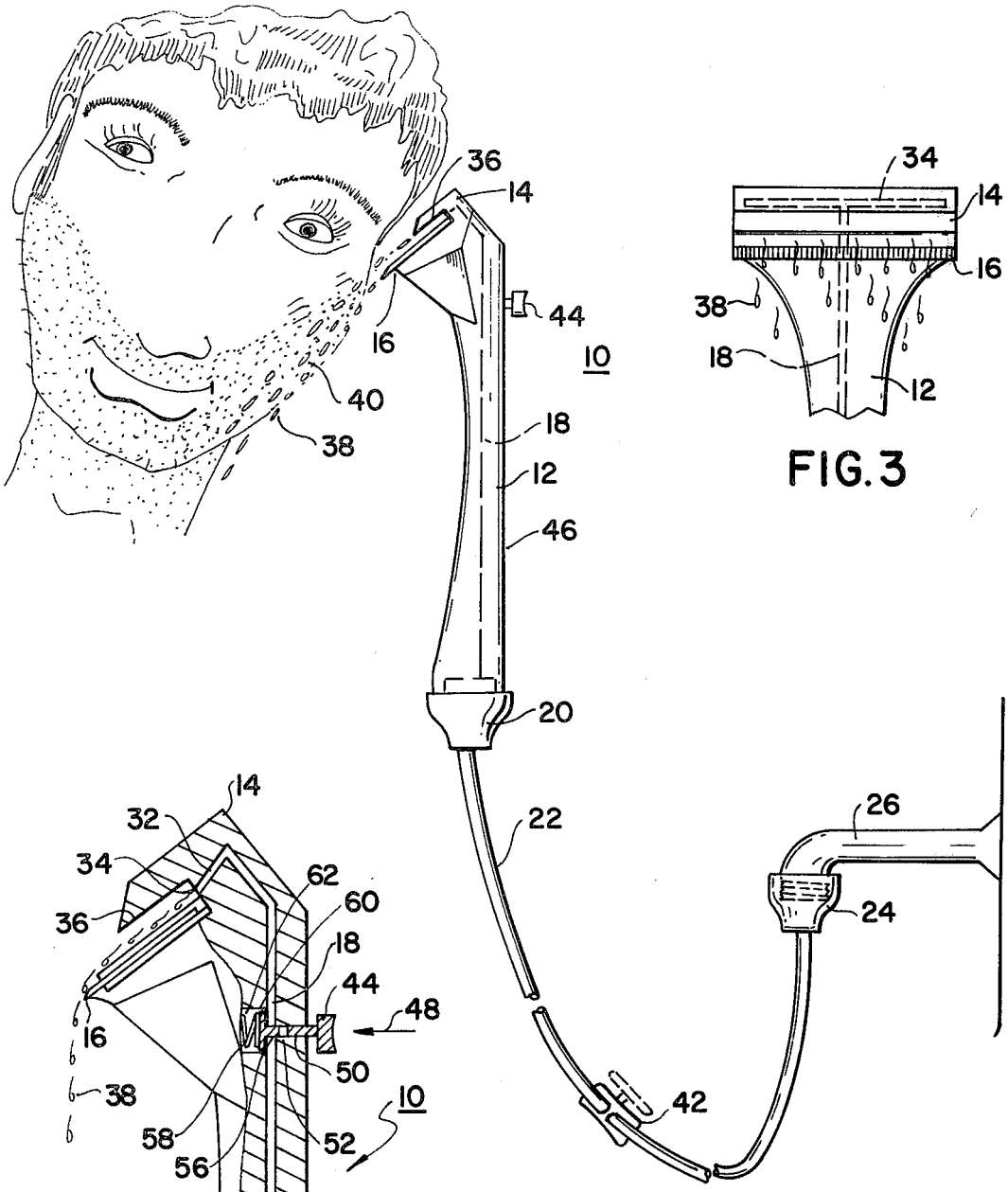
FIG.1
FIG.3
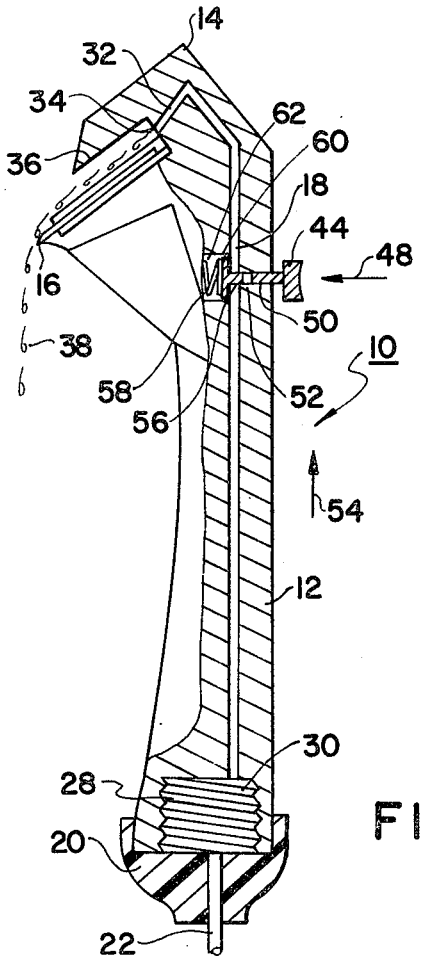
FIG. 2

WATER DISPENSING RAZOR

BACKGROUND OF THE INVENTION

1. Field of the Invention

The present invention relates to safety razors and particularly to a razor having an integral water supply passageway.

2. Description of the Prior Art

In order to obtain close, smooth shaves and to minimize cuts when using a safety razor, it is necessary to maintain the skin in a moist lubricated condition. Various devices have been proposed which have fluid dispensing containers and tubes attached to or within the handle of a razor. These devices have generally been quite complex, difficult to use and require entirely new razor configurations, such as shown in U.S. Pat. No. 3,139,683, issued July 7, 1964, and U.S. Pat. No. 2,336,806, issued Dec. 14, 1943.

SUMMARY OF THE INVENTION

It is therefore the primary object of the present invention to provide a safety razor having a simplified water dispensing arrangement which does not require extensive modifications of standard razor types.

This is achieved with a razor for a single edge type blade wherein an integral longitudinal passageway is provided in the handle. The upper end of the passageway has a lateral slotted opening extending along the shaving head above and behind the blade. A flexible length of tubing with a simple coupling connects the lower end of the passageway and handle to a water faucet. When the water is turned on, a steady stream flows out of the slot over the blade to lubricate the facial areas being shaved. The flow is regulated by an adjustable clamp on the tubing. Other objects and advantages will become apparent from the following description in conjunction with the accompanying drawings.

BRIEF DESCRIPTION OF THE DRAWINGS

FIG. 1 is a pictorial representation showing the razor connected to a water faucet and applying water to facial areas;

FIG. 2 is a side partial cross-sectional view of the razor showing the water passageway, slot and blade; and FIG. 3 is a partial front view of the razor.

DESCRIPTION OF THE PREFERRED EMBODIMENT

As shown in FIG. 1 a safety razor 10 has a handle 12 and shaving head portion 14 containing a single edge type blade 16. Running lengthwise through the handle which is preferably of a rigid plastic or lightweight metal material, is a narrow longitudinal passageway or channel 18, shown in more detail in FIG. 2. The lower end of the handle and passageway have a flexible coupling 20 connected to a length of flexible hollow tubing 22, preferably of plastic or rubber. The other end of the tubing has another flexible push on type hose coupler 24 which is mounted on the end of a water faucet 26.

The coupling 20 at the end of the handle preferably includes a threaded insert 28 engaging a mating threaded bore 30. A hole in the insert (not shown) is aligned with the hollow tubing to admit water. The passageway 18 has an opening in bore 30 and extends through the length of the handle. The passageway bends toward the shaving head 14 at the upper end and has a downwardly directed laterally extending slot 32 with a opening 34 that is positioned over and behind the razor blade 16. FIG. 3 shows the opening 34 extending across the width of the flared head 14.

The razor blade 16 is secured within an angled recess 36 in the head so that the blade edge normally faces down toward the facial areas to be shaved. The opening 34 is in the back wall of the recess over the blade with water 38 being directed down over the top of the blade to wet the face 40. The single edge blade may be secured in the recess in any suitable known manner and may also be in the form of an injector blade in a cartridge or a dual tracking blade with two parallel spaced cutting edges. The height of the recess and water slot are designed to accommodate the particular razor blade. The flow of water from the faucet is controlled to any desired degree by an adjustable clamp 42 secured around the tubing 22.

FIG. 1 and FIG. 2 illustrate operating lever 44 disposed outwardly from the surface 46 of handle 12 at a location between shaving head portion 14 and flexible coupling 20. The manual depression of operating lever 44 in the direction of arrow 48 causes rod 50 to move in a leftward direction such that opening 52 may be disposed aligned with passageway 18. When so depressed, rod 50 and opening 52 acts like a normally open valve permitting the flow of liquid, not shown, through passageway 18 in the direction of arrow 54. At other times, when operating lever 44 is not depressed, portion 56 of rod 50 prevents the flow of liquid through passageway 18. Helical spring 58 is shown wrapped about the leftmost end of rod 50 such that the rightmost end of spring 58 is shown in touching engagement with washer-like plate 60, secured to rod 50. The leftmost end of spring 58 is allowed to engage an interior portion of cavity 62, located in handle 12. Thus, a user may manipulate safety razor 10 with complete freedom from having water 38 emerge from shaving head portion 14 in between actual shaving operations. Operating lever 44 and rod 50 and spring 58 may be utilized with or without the inclusion of adjustable clamp 42 secured around tubing 22. Thus, the user may select the maximum rate of flow of water 38 by adjusting clamp 42 and simply utilizing the valve portions of the apparatus to completely turn on or completely turn off the water flow. Alternatively, adjustable clamp 42 may be removed from tubing 22 so that the user may employ operating lever 44 in variable states of inward depression so as to control the amount of water 38 emerging from shaving head portion 14.

While only a single embodiment has been illustrated and described, it is apparent that many variations may be made in the design and configuration without departing from the scope of the invention as set forth in the appended claims.

What is claimed is:

1. A liquid dispensing razor comprising:

(a) an elongated handle;

(b) a shaving head at one end of said handle, said handle having a longitudinal passageway therethrough and an opening at the other end thereof for connection to a source of liquid, a razor blade, said head further including a supporting surface for receiving and supporting said razor blade thereon, said razor blade having opposed lateral first and second surfaces and a pair of opposed marginal edges, one of said marginal edges being sharpened along the length thereof, said first lateral surface being disposed in touching engagement with said supporting surface, said handle having a laterally extending slotted opening disposed over said second lateral surface of said blade and adjacent the other of said marginal edges of said blade, said slotted opening communicating with said longitudinal passageway for directing said liquid across only said second lateral surface of said blade, said first lateral surface being located intermediate said second lateral surface and said other end of said handle, said slotted opening being substantially equal in length to the length of said other marginal edge of said blade, a valve, said valve being installed on said handle at a location intermediate the ends of said handle, said valve having an operating lever, said operating lever being located outwardly from said handle adjacent said location, means to bias said valve into a closed condition preventing the flow of said liquid through said passageway, whereby the momentary manual operation of said operation of said operating lever allows said liquid to flow through said passageway and over substatially all of said second lateral surface of said blade and over said one marginal edge of said blade.

2. The device of claim 1 wherein said blade comprises a single edge type razor blade, said supporting surface being at a downwardly sloping angle relative to said longitudinal passageway.

3. The device of claim 1 further wherein said valve comprises a spring, a rod, one end of said spring engaged with said handle, the other end of said spring engaging said rod, said rod having an opening therethrough, said operating lever affixed to one end of said rod, said spring biasing said rod such that said opening is disposed outwardly of said passageway.

* * * * *